US007270611B2

(12) United States Patent
Watanabe et al.

(10) Patent No.: US 7,270,611 B2
(45) **Date of Patent: *Sep. 18, 2007**

(54) GOLF BALL

(75) Inventors: Hideo Watanabe, Chichibu (JP); Junji Hayashi, Chichibu (JP); Rinya Takesue, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/168,427

(22) Filed: Jun. 29, 2005

(65) Prior Publication Data

US 2005/0239577 A1 Oct. 27, 2005

Related U.S. Application Data

(63) Continuation-in-part of application No. 10/765,088, filed on Jan. 28, 2004.

(51) Int. Cl.
*A63B 37/06* (2006.01)

(52) U.S. Cl. ..... 473/373

(58) Field of Classification Search ..... 473/373, 473/374, 378, 376, 377

See application file for complete search history.

(56) References Cited

U.S. PATENT DOCUMENTS

| | | | | |
|---|---|---|---|---|
| 5,306,760 | A | 4/1994 | Sullivan | |
| 5,312,857 | A | 5/1994 | Sullivan | |
| 5,830,085 | A | 11/1998 | Higuchi et al. | |
| 5,935,022 | A | 8/1999 | Sugimoto et al. | |
| 5,967,908 | A | 10/1999 | Yamagishi et al. | |
| 6,213,896 | B1 | 4/2001 | Higuchi et al. | |
| 6,514,158 | B1 | 2/2003 | Nakamura et al. | |
| 2001/0016522 | A1* | 8/2001 | Watanabe et al. | 473/371 |
| 2001/0031669 | A1 | 10/2001 | Ohama | |
| 2004/0198534 | A1 | 10/2004 | Sasaki | |
| 2005/0164809 | A1* | 7/2005 | Watanabe et al. | 473/371 |
| 2005/0239578 | A1* | 10/2005 | Watanabe et al. | 473/371 |
| 2006/0063612 | A1* | 3/2006 | Watanabe et al. | 473/371 |
| 2006/0116221 | A1* | 6/2006 | Watanabe et al. | 473/371 |
| 2006/0128504 | A1* | 6/2006 | Watanabe et al. | 473/371 |

FOREIGN PATENT DOCUMENTS

| | | | |
|---|---|---|---|
| JP | 09-313643 | A | 12/1997 |
| JP | 10-305114 | A | 11/1998 |
| WO | WO98/46671 | A1 | 10/1998 |

* cited by examiner

*Primary Examiner*—Raeann Trimiew
(74) *Attorney, Agent, or Firm*—Sughrue Mion Pllc.

(57) ABSTRACT

A golf ball comprising a core, an intermediate layer, and a cover exhibits a good profile of rebound, feel and durability suited for low head speed amateur players when it satisfies the requirements that (Shore D hardness of the cover)−(Shore D hardness of the intermediate layer)>0, (initial velocity (in m/s) of the core enclosed with the intermediate layer)−(initial velocity (in m/s) of the core)>−0.2, 0.90≦(Deflection amount of the core enclosed with the intermediate layer)/(Deflection amount of the core)≦1.00.

8 Claims, No Drawings

GOLF BALL

CROSS-REFERENCE TO RELATED APPLICATION

This application is a continuation-in-part of copending application Ser. No. 10/765,088 filed on Jan. 28, 2004, the entire contents of which are hereby incorporated by reference.

BACKGROUND OF THE INVENTION

1. Technical Field

This invention relates to a golf ball having a good profile of rebound, feel and durability suited for low head speed amateur players to play.

2. Prior Art

With the currently increasing population of golfers, the requirements on golf balls have been diversified and personalized. Golf balls have hitherto been modified and improved in a variety of ways to address such requirements of golfers.

For example, JP-A 9-313643 discloses a golf ball comprising a core, intermediate layer and cover which has optimized the hardness distribution of the core and the hardness distribution of the entire ball, thus simultaneously satisfying all requirements including excellent flight performance, durability, a good feel on impact and controllability. Also, JP-A 10-305114 describes a golf ball comprising a solid core, intermediate layer and cover, the cover having a plurality of dimples formed on a surface thereof, which has optimized the hardness balance among the core, intermediate layer and cover and the parameters of dimples, thereby improving the feel on impact and flight performance independent of head speed.

In addition, there has been proposed another type of multi-piece golf ball consisting of a core, an intermediate layer, and a cover, which is claimed to have good feel as well as improved flight performance owing to the adequate ratio between the deflection hardness of the core coated with the intermediate layer and the deflection hardness of the core alone according to JP-A 2001-218875. There has also been proposed another type of multi-piece golf ball consisting of a core, an intermediate layer, and a cover, in which the intermediate layer has a specific thickness and a specific hardness which are related with each other according to JP-A 2001-252374.

However, these golf balls are still insufficient in rebound. There is a need for golf balls that satisfy all properties of rebound, feel and durability on use by amateur players who swing at low head speeds.

SUMMARY OF THE INVENTION

An object of the invention is to provide a golf ball having a good profile of rebound, feel and durability suited for low head speed amateur players.

The invention pertains to a golf ball comprising a core having a plurality layers, an intermediate layer enclosing the core to form a sphere, and a cover enclosing the intermediate layer. It has been found that when the balance of Shore D hardness between the intermediate layer and the cover, the balance of initial velocity between the core and the sphere, and the balance of Deflection amount between the core and the sphere are optimized, and the total thickness of the intermediate layer and the cover is properly selected, the golf ball is given a good profile of rebound, feel and durability suited for low head speed amateur players to play. The present invention is predicated on this finding.

Accordingly, the present invention provides a golf ball comprising a core having a plurality layers, an intermediate layer enclosing the core to form a sphere, and a cover enclosing the intermediate layer, wherein each component has a Shore D hardness, a Deflection amount, an initial velocity (in m/s) and a thickness (in mm), the Deflection amount being defined as an amount of deflection (in mm) under load of a spherical body incurred when the load is increased from an initial value of 98 N (10 kgf) to a final value of 1275 N (130 kgf), and the ball satisfies the following requirements (1) to (3):

(1) (Shore D hardness of the cover)−(Shore D hardness of the intermediate layer)>0, (2) (initial velocity of the sphere)−(initial velocity of the core)>−0.2, and (3) 0.90≦(Deflection amount of the sphere)/(Deflection amount of the core)≦1.00.

The preferred golf ball further satisfies the following requirements (4) and (5) to (9):

(4) the total of the thickness of the intermediate layer and the thickness of the cover is up to 3.0 mm, (5) the thickness of the cover is from 0.5 mm to 2.0 mm, (6) the Shore D hardness of the cover is from 55 to 70, (7) the thickness of the intermediate layer is from 0.5 mm to 1.6 mm, (8) the Shore D hardness of the intermediate layer is from 40 to 60, and (9) the golf ball has an initial velocity of at least 76.5 m/s.

In a preferred embodiment, the golf ball further satisfies the following requirement (10):

(10) the cover has a melt flow rate of at least 2 g/10 min.

In a further preferred embodiment, the golf ball further satisfies the following requirement (11):

(11) 0.85≦(Deflection amount of the golf ball)/(Deflection amount of the sphere)≦0.95.

In a further preferred embodiment, the golf ball further satisfies the following requirement (12):

(12) (JIS-C hardness of core surface)−(JIS-C hardness of core center)≧20.

In a further preferred embodiment, the golf ball further satisfies the following requirement (13):

(13) 5≧(JIS-C hardness of surface of intermediate layer)−(JIS-C hardness of core surface)≧−5.

In the preferred golf ball, the intermediate layer comprises (A) an ionomer resin comprising (a-1) an olefin/unsaturated carboxylic acid binary random copolymer and/or a metal ion neutralized product thereof and (a-2) an olefin/unsaturated carboxylic acid/unsaturated carboxylic acid ester ternary random copolymer and/or a metal ion neutralized product thereof in a weight ratio (a-1)/(a-2) between 100/0 and 0/100, and (B) a non-ionomeric thermoplastic elastomer in a weight ratio A/B between 100/0 and 50/50.

More preferably, the intermediate layer is made of a mixture comprising 100 parts by weight of a resin component comprising the ionomer resin (A) and the non-ionomeric thermoplastic elastomer (B) in a weight ratio A/B between 100/0 and 50/50, (C) 5 to 80 parts by weight of an organic fatty acid and/or a derivative thereof having a molecular weight of 280 to 1,500, and (D) 0.1 to 10 parts by weight of a basic inorganic metal compound capable of neutralizing un-neutralized acid groups in the resin component and component (C).

The golf ball of the invention exhibits a good profile of rebound, feel and durability when low head speed amateur players play with it.

DESCRIPTION OF THE PREFERRED EMBODIMENTS

The golf ball of the invention comprises a core having a plurality layers, an intermediate layer enclosing the core to form a sphere, and a cover enclosing the intermediate layer. The ball satisfies the following requirements (1) to (3):

(1) (Shore D hardness of the cover)−(Shore D hardness of the intermediate layer)>0, (2) (initial velocity (in m/s) of the sphere)−(initial velocity (in m/s) of the core)>−0.2, and (3) 0.90≦[(Deflection amount of the sphere)/(Deflection amount of the core)]≦1.00.

As used herein, the term "sphere" means the core enclosed with the intermediate layer unless otherwise stated.

As used herein, the "Deflection amount" is defined as the amount of deflection or deformation (in mm) under load of a spherical body incurred when the load is increased from an initial value of 98 N (10 kgf) to a final value of 1275 N (130 kgf). The term "spherical body" is used to include the core, the sphere and the ball.

Intermediate Layer and Cover

The intermediate layer and/or the cover is preferably formed of a material which comprises (A) an ionomer resin comprising (a-1) an olefin/unsaturated carboxylic acid binary random copolymer and/or a metal ion neutralized olefin/unsaturated carboxylic acid binary random copolymer and (a-2) an olefin/unsaturated carboxylic acid/unsaturated carboxylic acid ester ternary random copolymer and/or a metal ion neutralized olefin/unsaturated carboxylic acid/unsaturated carboxylic acid ester ternary random copolymer in a weight ratio (a-1)/(a-2) between 100/0 and 0/100, and (B) a non-ionomeric thermoplastic elastomer in a weight ratio A/B between 100/0 and 50/50; and more preferably a mixture comprising 100 parts by weight of a resin component comprising the ionomer resin (A) and the non-ionomeric thermoplastic elastomer (B) in a weight ratio A/B between 100/0 and 50/50, (C) 5 to 80 parts by weight of an organic fatty acid and/or a derivative thereof having a molecular weight of 280 to 1,500, and (D) 0.1 to 10 parts by weight of a basic inorganic metal compound capable of neutralizing un-neutralized acid groups in the resin component and component (C).

The olefins in components (a-1) and (a-2) have a number of carbon atoms that is generally at least 2, but not more than 8, and preferably not more than 6. Specific examples of olefins include ethylene, propylene, butene, pentene, hexene, heptene and octene. Ethylene is especially preferred.

Suitable examples of the unsaturated carboxylic acid include acrylic acid, methacrylic acid, maleic acid and fumaric acid. Acrylic acid and methacrylic acid are especially preferred.

The unsaturated carboxylic acid esters in component (a-2) include lower alkyl esters of the foregoing unsaturated carboxylic acids. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, isobutyl acrylate) is especially preferred.

The olefin/unsaturated carboxylic acid binary random copolymer of component (a-1) and the olefin/unsaturated carboxylic acid/unsaturated carboxylic acid ester ternary random copolymer of component (a-2) (the copolymers are collectively referred to as "random copolymers," hereinafter) can each be obtained by suitably formulating the above-described olefin, unsaturated carboxylic acid and optional unsaturated carboxylic acid ester and carrying out random copolymerization in a conventional manner.

It is recommended that the random copolymers be prepared such as to have a specific unsaturated carboxylic acid content (sometimes referred to as the "acid content," hereinafter). The amount of unsaturated carboxylic acid included within the random copolymer of component (a-1) is generally at least 4 wt %, preferably at least 6 wt %, more preferably at least 8 wt %, and most preferably at least 10 wt %, but generally not more than 30 wt %, preferably not more than 20 wt %, more preferably not more than 18 wt %, and most preferably not more than 15 wt %. Similarly, the amount of unsaturated carboxylic acid included within the random copolymer of component (a-2) is generally at least 4 wt %, preferably at least 6 wt %, and more preferably at least 8 wt %, but not more than 15 wt %, preferably not more than 12 wt %, and more preferably not more than 10 wt %. If the random copolymer of component (a-1) and/or (a-2) has too low an acid content, resilience may decline. Too high an acid content may lower processability.

The metal ion neutralized product of an olefin/unsaturated carboxylic acid binary random copolymer in component (a-1) and the metal ion neutralized product of an olefin/unsaturated carboxylic acid/unsaturated carboxylic acid ester ternary random copolymer in component (a-2) (the metal ion neutralized products of such copolymers are collectively referred to as "metal ion-neutralized random copolymers," hereinafter) can each be obtained by neutralizing some or all of the acid groups on the random copolymer with metal ions.

Illustrative examples of metal ions for neutralizing the acid groups on the random copolymer include $Na^+$, $K^+$, $Li^+$, $Zn^{2+}$, $Cu^{2+}$, $Mg^{2+}$, $Ca^{2+}$, $Co^{2+}$, $Ni^{2+}$ and $Pb^{2+}$. Preferred metal ions are $Na^+$, $Li^+$, $Zn^{2+}$ and $Mg^{2+}$. The use of $Na^+$ is especially recommended for improved resilience.

The metal ion-neutralized random copolymers may be prepared by neutralization with such metal ions. For example, formates, acetates, nitrates, carbonates, bicarbonates, oxides, hydroxides or alkoxides of the above metal ions are added to the acid group-bearing random copolymers to neutralize acid groups. The degree of neutralization of the random copolymer with metal ions is not particularly limited.

Commercial products may be used as components (a-1) and (a-2). Exemplary commercial products that may be used as the random copolymer in component (a-1) include Nucrel 1560, Nucrel 1214 and Nucrel 1035 (Du Pont-Mitsui Polychemicals Co., Ltd.), and Escor 5200, Escor 5100 and Escor 5000 (ExxonMobil Chemical Company).

Exemplary commercial products that may be used as the metal ion-neutralized random copolymer in component (a-1) include Himilan 1554, Himilan 1557, Himilan 1601, Himilan 1605, Himilan 1706 and Himilan AM7311 (Du Pont-Mitsui Polychemicals Co., Ltd.), Surlyn 7930 (E.I. du Pont de Nemours & Co., Inc.) and Iotek 3110 and Iotek 4200 (ExxonMobil Chemical Company).

Exemplary commercial products that may be used as the random copolymer in component (a-2) include Nucrel AN4311 and Nucrel AN4318 (Du Pont-Mitsui Polychemicals Co., Ltd.), and Escor ATX325, Escor ATX320 and Escor ATX310 (ExxonMobil Chemical Company).

Exemplary commercial products that may be used as the metal ion-neutralized random copolymer in component (a-2) include Himilan 1855, Himilan 1856 and Himilan AM7316 (Du Pont-Mitsui Polychemicals Co., Ltd.), Surlyn 6320, Surlyn 8320, Surlyn 9320 and Surlyn 8120 (E.I. du Pont de Nemours & Co., Inc.), and Iotek 7510 and Iotek 7520 (ExxonMobil Chemical Company).

The random copolymers and metal ion-neutralized random copolymers may be used alone or in admixture of any as each component (a-1) or (a-2). Examples of sodium-neutralized ionomer resins which are preferred as the metal ion-neutralized random copolymers include Himilan 1605, Himilan 1601 and Surlyn 8120.

Component (a-2) generally accounts for greater than or equal to 0 wt % (% by weight), preferably greater than or equal to 50 wt % of the total weight of components (a-1) and (a-2) while the upper limit of component (a-2) content is generally less than or equal to 100 wt %.

Component (B) is a non-ionomeric thermoplastic elastomer which is preferably included to further enhance both the feel of the golf ball upon impact and its rebound characteristics. In this disclosure, the ionomer resin (A) and non-ionomeric thermoplastic elastomer (B) are collectively referred to as the "resin component."

Specific examples of the non-ionomeric thermoplastic elastomer (B) include olefinic elastomers, styrenic elastomers, polyester elastomers, urethane elastomers and polyamide elastomers. Of these, olefinic elastomers and polyester elastomers are preferred for further increasing resilience.

Commercial products may be used as component (B). An exemplary olefinic elastomer is Dynaron (JSR Corporation) and an exemplary polyester elastomer is Hytrel (Du Pont-Toray Co., Ltd.). They may be used alone or in admixture.

Component (B) generally accounts for greater than or equal to 0 wt %, preferably greater than or equal to 20 wt % based on the total weight of the resin component while the upper limit of component (B) content is generally less than or equal to 50 wt %, preferably less than or equal to 40 wt %. If the content of component (B) in the resin component is more than 50 wt %, the respective components may become less compatible, resulting in golf balls with a drastic decline of durability.

Component (C) is an organic fatty acid and/or fatty acid derivative having a molecular weight of 280 to 1,500. This component is advantageously included because its molecular weight is very low compared to the resin component and it is effective to adjust the melt viscosity of the mixture to a suitable level, particularly to help improve flow.

The molecular weight of the organic fatty acid or fatty acid derivative (C) is generally at least 280, preferably at least 300, more preferably at least 330, and most preferably at least 360, but not more than 1,500, preferably not more than 1,000, more preferably not more than 600, and most preferably not more than 500. Too low a molecular weight may lead to poor heat resistance whereas too high a molecular weight may fail to improve flow.

Preferred examples of the organic fatty acid (C) include unsaturated organic fatty acids having a double bond or triple bond on the alkyl group, and saturated organic fatty acids in which all the bonds on the alkyl group are single bonds. It is recommended that the number of carbons on the organic fatty acid molecule be generally at least 18, preferably at least 20, more preferably at least 22, and most preferably at least 24, but up to 80, preferably up to 60, more preferably up to 40, and most preferably up to 30. Too few carbons may lead to poor heat resistance and may also make the content of acid groups relatively high so as to diminish the flow-enhancing effect on account of excessive interactions with acid groups in the resin component. On the other hand, too many carbons increases the molecular weight, which may prevent the significant flow-enhancing effect from being achieved.

Specific examples of organic fatty acids that may be used as component (C) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

Organic fatty acid derivatives which may be used as component (C) include metallic soaps in which the proton on the acid group of the above organic fatty acid is substituted with a metal ion. Metal ions that may be used in such metallic soaps include $Na^{+}$, $Li^{+}$, $Ca^{2+}$, $Mg^{2+}$, $Zn^{2+}$, $Mn^{2+}$, $Al^{3+}$, $Ni^{2+}$, $Fe^{2+}$, $Fe^{3+}$, $Cu^{2+}$, $Sn^{2+}$, $Pb^{2+}$ and $Co^{2+}$. Of these, $Ca^{2+}$, $Mg^{2+}$ and $Zn^{2+}$ are preferred.

Specific examples of organic fatty acid derivatives that may be used as component (C) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred. They may be used alone or in admixture of any.

The amount of component (C) included is generally at least 5 parts by weight (pbw), preferably at least 10 pbw, more preferably at least 15 pbw, and most preferably at least 18 pbw, per 100 pbw of the resin component (i.e., A+B). The upper limit of component (C) amount is generally up to 80 pbw, preferably up to 40 pbw, more preferably up to 25 pbw, and most preferably up to 22 pbw per 100 pbw of the resin component. Too small an amount of component (C) included may lead to a very low melt viscosity and hence, poor processability whereas too large an amount of component (C) may adversely affect durability.

It is noted that known metallic soap-modified ionomers, including those described in U.S. Pat. No. 5,312,857, U.S. Pat. No. 5,306,760 and International Application WO 98/46671, may be used as the combination of ionomer resin (A) with component (C).

Component (D) is a basic inorganic metal compound which can neutralize un-neutralized acid groups in the resin component and component (C). If a metallic soap-modified ionomer resin is used alone without including component (D), for example, the metallic soap and the un-neutralized acid groups present on the ionomer resin undergo exchange reactions during heat mixing, generating a large amount of fatty acid which will readily vaporize. The fatty acid thus generated can cause problems to molded parts, for example, molded parts having defects, poor adhesion of paint film, and low rebound. To avoid such problems, component (D) is advantageously included.

Preferred component (D) is a basic inorganic metal compound which is highly reactive with the resin component and forms reaction by-products devoid of organic acids.

Illustrative examples of the metal ions in the basic inorganic metal compound (D) include $Li^+$, $Na^+$, $K^+$, $Ca^{2+}$, $Mg^{2+}$, $Zn^{2+}$, $Al^{3+}$, $Ni^{2+}$, $Fe^{2+}$, $Fe^{3+}$, $Cu^{2+}$, $Mn^{2+}$ $Sn^{2+}$, $Pb^{2+}$ and $Co^{2+}$. These metal ions may be used alone or in admixture of any. Known basic inorganic fillers containing these metal ions may be used as the basic inorganic metal compound (D). Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. Inter alia, hydroxides and monoxides are recommended. Calcium hydroxide and magnesium oxide are especially preferred because they have a high reactivity with the resin component.

The amount of basic inorganic metal compound (D) included is generally at least 0.1 part by weight (pbw), preferably at least 0.5 pbw, more preferably at least 1 pbw, and most preferably at least 2 pbw, per 100 pbw of the resin component (i.e., A+B). As to the upper limit, the amount of component (D) is generally up to 10 pbw, preferably up to 8 pbw, more preferably up to 6 pbw, and most preferably up to 5 pbw per 100 pbw of the resin component. Too small an amount of component (D) included may fail to achieve improvements in thermal stability and resilience whereas too large an amount of component (D) may rather adversely affect the heat resistance of a golf ball material.

It is generally recommended that the mixture formulated by combining components (A) to (D) have a degree of neutralization which is at least 50 mol %, preferably at least 60 mol %, more preferably at least 70 mol %, and most preferably at least 80 mol %, based on the entire amount of acid groups in the mixture. The mixture with such a high degree of neutralization offers the advantage that even on use of a metal soap-modified ionomer resin, for example, the exchange reactions between the metal soap and un-neutralized acid groups in the ionomer resin during heat mixing are retarded, thus minimizing the risk of compromising the thermal stability, moldability and resilience of the mixture.

In addition to the aforementioned components (A) to (D), the material of which the intermediate layer and/or the cover is made in the practice of the invention may further include such additives as pigments, dispersants, antioxidants, ultraviolet absorbers and light stabilizers. Such additives may be incorporated in any desired amounts. The amount of additive is typically at least 0.1 pbw, preferably at least 0.5 pbw, more preferably at least 1 pbw per 100 pbw of the resin component (i.e., A+B). As to the upper limit, the amount of additive is typically up to 10 pbw, preferably up to 6 pbw, more preferably up to 4 pbw per 100 pbw of the resin component.

The material for the intermediate layer and/or the cover can be prepared by combining the essential and optional components described above, heating and mixing them together. For example, they are mixed on an internal mixer such as a kneading-type twin-screw extruder, a Banbury mixer or a kneader while heating at a temperature of 150 to 250° C.

Core

The present invention requires that the core has a plurality layers. Particularly, it is desirable that the core has two layers consisting of a center core layer and an outer layer. In this case, the center core should have a diameter no smaller than 15 mm, preferably no smaller than 20 mm, more preferably no smaller than 23 mm, and no larger than 35 mm, preferably no larger than 30 mm, more preferably no larger than 27 mm. With an excessively small diameter, the resulting golf ball may be poor in flight performance due to insufficient spin reducing effect. With an excessively large diameter, the resulting golf ball may be poor in resistance to repeated when hitting because the outer layer must be adjusted comparatively thin.

The core having a plurality layers may be formed from any known rubber material based on polybutadiene or polyisoprene. Such a rubber material may be formed from the following ingredients, for instance; 100 pbw of cis-1,4-polybutadiene; 10 to 60 pbw of a mixture of monomer and crosslinking agent in which the monomer is one or more species of α,β-monoethylene unsaturated carboxylic acid, such as acrylic acid and methacrylic acid, neutralized with metal ions, and the crosslinking agent is one or more species of functional monomer, such as trimethylolpropane methacrylate; 5 to 30 pbw of filler, such as zinc oxide and barium sulfate; 0.5 to 5 pbw of peroxide, such as dicumyl peroxide; and 0.1 to 1 pbw of antioxidant, optionally. The core having a plurality layers may be formed in the usual way by compressing the raw material into a sphere with heating at 140 to 180° C. for 10 to 60 minutes.

The outer layer enclosing the center core may be formed from a rubber material which is identical with or different from the above-mentioned one used for the center core.

The outer layer may be formed on the center core in the following manner. First, a pair of semispherical cups are formed from unvulcanized rubber in sheet form. Then, the center core is enclosed in them, and the resulting assembly is heated under pressure. Another method may be carried out as follows. First, a pair of semispherical cups are made by half vulcanization. Then, the center core previously enclosed with the outer layer is placed in one of the semispherical cup and enclosed with the other semispherical cup. Finally, the resulting assembly is completely vulcanized. Further another method may be carried out as follows. First, unvulcanized sheets are formed from a rubber compound. Then, each sheet is formed into semispherical cups by molding with a mold having a semispherical projection, and the thus molded semispherical cup is placed on the center core. The assembly is compressed with heating at 140 to 180° C. for 10 to 60 minutes. In this method, vulcanization is accomplished in two stages.

According to the present invention, the whole core should have a deflection hardness no lower than 3.0 mm, preferably no lower than 3.3 mm, more preferably no lower than 3.6 mm and no higher than 6.0 mm, preferably no higher than 5.0 mm, more preferably no higher than 4.6 mm. With a deflection hardness lower than 3.0 mm, the resulting golf ball has a hard feel and poor in flight performance due to increased spin. With a deflection hardness higher than 6.0 mm, the resulting golf ball may be poor in flight performance due to low rebound resilience, has an excessively soft feel, or may be poor in crack durability when repeated hitting.

The whole core should have a diameter no smaller than 36.5 mm, preferably no smaller than 37 mm, more preferably no smaller than 37.5 mm, and no larger than 40 mm, preferably no larger than 39.5 mm, more preferably no larger than 39 mm. With a diameter outside this range, the resulting golf ball may be poor in crack durability when repeated hitting and may be also poor in flight performance due to excessive spin at the time of hitting with a driver (W#1).

In addition, the core should have a specific gravity of no lower than 1.05 g/cm$^3$, preferably no lower than 1.15 g/cm$^3$, and no higher than 1.35 g/cm$^3$, more preferably no higher than 1.25 g/cm$^3$.

Moreover, the core center should have a JIS-C hardness no lower than 30, preferably no lower than 40, more preferably no lower than 45, and no higher than 60, preferably no higher than 55, more preferably no higher than 53. With a JIS-C hardness higher than 60, the resulting golf ball may be poor in flight performance due to excessive spin and has a hard feel. With a JIS-C hardness lower than 30, the resulting golf ball may be poor in flight performance due to low rebound resilience, has an excessively soft feel, and may be poor in crack durability when repeated hitting. The core surface should have a JIS-C hardness no lower than 65, preferably no lower than 70, more preferably no lower than 75, and no higher than 90, preferably no higher than 85, more preferably no higher than 80. With a JIS-C hardness higher than 80, the resulting golf ball has an excessively hard feel. With a JIS-C hardness lower than 65, the resulting golf ball may be poor in flight performance due to low rebound resilience, has an excessively soft feel, and may be poor in crack durability when repeated hitting. The surface of the core and the surface of the intermediate layer should have respective values of JIS-C hardness such that their difference is ±5, preferably ±4, more preferably ±3. Failure to meet this requirement may result in a golf ball lacking both improved carry and improved feel.

While it is recommended the core, the intermediate layer and the cover of the inventive golf ball be formed of the above-described materials, respectively, the invention intends to provide a golf ball having a good profile of rebound, feel and durability suited for low-head-speed amateur players by optimizing the balance of Shore D hardness between the intermediate layer and the cover as specified by requirement (1), the balance of initial velocity between the core and the sphere as specified by requirement (2), and the balance of Deflection amount between the core and the sphere as specified by requirement (3). The ball should satisfy the following requirements (1) to (3).

(1) (Shore D hardness of the cover)−(Shore D hardness of the intermediate layer)>0.
(2) (initial velocity (in m/s) of the sphere)−(initial velocity (in m/s) of the core)>−0.2.
(3) 0.90≦(Deflection amount of the sphere)/(Deflection amount of the core)≦1.00.

In order to enhance the advantages, the golf ball should desirably satisfy the following requirements (4) to (13).

(4) The total of the thickness (in mm) of the intermediate layer and the thickness (in mm) of the cover is equal to or less than 3.0 mm.
(5) The thickness (in mm) of the cover is from 0.5 mm to 2.0 mm.
(6) The Shore D hardness of the cover is from 55 to 70.
(7) The thickness (in mm) of the intermediate layer is from 0.5 mm to 1.6 mm.
(8) The Shore D hardness of the intermediate layer is from 40 to 60.
(9) The golf ball has an initial velocity of at least 76.5 m/s.
(10) The cover has a melt flow rate (MFR) of at least 2 g/10 min.
(11) 0.85≦(Deflection amount of the golf ball)/(Deflection amount of the sphere)≧0.95.
(12) (JIS-C hardness of core surface)−(JIS-C hardness of core center)≧20.
(13) 5≧(JIS-C hardness of surface of intermediate layer)−(JIS-C hardness of core surface)≧−5.

Regarding Requirement (1):

In the inventive golf ball, the difference of the Shore D hardness of the cover minus the Shore D hardness of the intermediate layer is more than 0, preferably at least 5, and more preferably at least 10, but up to 30, preferably up to 20, and more preferably up to 15. If the difference is 0 or negative, the flight distance becomes short due to more spin receptivity. If the difference is more than 30, the flight distance may become short due to less rebound.

Regarding Requirement (2):

In the inventive golf ball, the difference of the initial velocity (in m/s) of the sphere minus the initial velocity (in m/s) of the core is more than −0.2, preferably at least 0, more preferably at least 0.1, especially preferably 0.2. If the difference is −0.2 or negative, the flight distance becomes short due to less rebound. The effective means for meeting requirement (2) is to form the intermediate layer from a highly resilient material. Making the intermediate layer harder and the core softer and less resilient is likely to meet requirement (2), but this means alone fails to achieve the advantages of the invention unless the remaining requirements are met at the same time.

It is noted that the "initial velocity" (in m/s) is measured using the same type of initial velocity instrument as the drum rotation instrument approved by the United States Golf Association (USGA). The balls were conditioned in an environment of 23±1° C. for more than 3 hours before they were tested in a room at a temperature of 23±2° C. Using a club with a head having a striking mass of 250 pounds (113.4 kg), the balls were hit at a head speed of 143.8 ft/s (43.83 m/s). A dozen of balls were hit each four times while the time for passage over a distance of 6.28 feet (1.91 m) was measured, from which the initial velocity (m/s) was computed. This cycle was completed within about 15 minutes.

Regarding Requirement (3):

In the inventive golf ball, the ratio of the Deflection amount of the sphere to the Deflection amount of the core is at least 0.90, preferably at least 0.92, and more preferably at least 0.94. As to the upper limit, the ratio is up to 1, preferably up to 0.98, and more preferably up to 0.96. A Deflection amount ratio of less than 0.90 leads to a hard feel when hit with a putter, and more spin and a resultant shorter travel distance when hit with a driver (W#1). A ratio of more than 1 leads to more spin and a resultant shorter travel distance when hit with a driver (W#1), and low durability against repeated impact.

The effective means for designing the golf ball so as to meet requirement (3) is to provide the intermediate layer with a Shore D hardness in a range of about 40 to about 60 and set the thickness of the intermediate layer and the hardness of the core in appropriate ranges.

Regarding Requirement (4):

In the inventive golf ball, the total of the thickness (in mm) of the intermediate layer and the thickness (in mm) of the cover is up to 3.0 mm, preferably up to 2.8 mm, and more preferably up to 2.6 mm. As to the lower limit, the total thickness is preferably at least 1.5 mm, more preferably at least 2.0 mm, even more preferably at least 2.4 mm. A total thickness of more than 3.0 mm leads to more spin and a resultant shorter travel distance when hit with a driver (W#1). A total thickness of less than 1.5 mm may lead to low durability against repeated impact.

Regarding Requirement (5):

In the inventive golf ball, the thickness (in mm) of the cover is usually at least 0.5 mm, preferably at least 0.9 mm, and more preferably at least 1.1 mm. As to the upper limit, the cover thickness is usually up to 2.0 mm, preferably up to 1.6 mm, and more preferably up to 1.3 mm. A cover thickness of less than 0.5 mm may lead to low durability against repeated impact. A cover thickness of more than 2.0 mm may worsen the feel on approach and putter shots.

Regarding Requirement (6):

In the inventive golf ball, the Shore D hardness of the cover is usually at least 55, preferably at least 57, and more preferably at least 60. As to the upper limit, the cover Shore D hardness is usually up to 70, preferably up to 66, and more preferably up to 63. A cover Shore D hardness of less than 55 may lead to a shortage of travel distance due to more spin or poor rebound, and poor scuff resistance. A cover Shore D hardness of more than 70 may lead to poor durability to cracking upon repeated impact and worsen the feel on impact in what the golfers refer to as "short game" and on putter shots.

Regarding Requirement (7):

In the inventive golf ball, the thickness (in mm) of the intermediate layer is usually at least 0.5 mm, preferably at least 0.8 mm, and more preferably at least 1.1 mm. As to the upper limit, the intermediate layer thickness is usually up to 1.6 mm, preferably up to 1.4 mm, and more preferably up to 1.3 mm. An intermediate layer thickness of less than 0.5 mm may lead to low durability to cracking upon repeated impact and a shorter travel distance due to low rebound. An intermediate layer thickness of more than 1.6 mm may lead to more spin and a resultant shorter travel distance when hit with a driver (W#1).

Regarding Requirement (8):

In the inventive golf ball, the Shore D hardness of the intermediate layer, which means sheet hardness of the material constructing intermediate layer, is usually at least 40, preferably at least 45, and more preferably at least 48. As to the upper limit, the intermediate layer Shore D hardness is usually up to 60, preferably up to 55, and more preferably up to 52. An intermediate layer Shore D hardness of less than 40 may lead to a shortage of travel distance due to more spin or poor rebound. An intermediate layer Shore D hardness of more than 60 may lead to poor durability to cracking upon repeated impact and worsen the feel on short-game and putter shots.

Regarding Requirement (9):

The inventive golf ball has an initial velocity of usually at least 76.5 m/s, preferably at least 76.8 m/s, and more preferably at least 77.0 m/s. As to the upper limit, the initial velocity is generally up to 77.724 m/s. With too low an initial velocity, the flight distance may become shorter. Beyond the upper limit of 77.724 m/s, which is outside the standard of the USGA, the balls cannot be registered as being authorized.

Regarding Requirement (10):

In the inventive golf ball, the cover material has a melt flow rate (MFR) of usually at least 2 g/10 min, preferably at least 2.5 g/10 min, and more preferably at least 3.0 g/10 min. A material with an MFR of less than 2 g/10 min may be difficult to mold or be molded into balls which have poor sphericity and vary in flight performance. As used herein, the melt flow rate (MFR) is measured according to JIS K6760 at a temperature of 190° C. and a load of 21.18 N (2.16 kgf).

Regarding Requirement (11):

In the inventive golf ball, the ratio of the Deflection amount of the golf ball to the Deflection amount of the sphere is usually at least 0.85, preferably at least 0.87, and more preferably at least 0.88. At to the upper limit, the Deflection amount ratio is usually up to 0.95, preferably up to 0.93, and more preferably up to 0.92. With too low or too high a ratio, the ball when hit with a driver (W#1) may receive more spin and thus travel a less distance.

The effective means for designing the golf ball so as to meet requirement (11) is to set the hardness and thickness of the cover and the Deflection amount of the sphere in appropriate ranges.

Regarding Requirement (12):

The multi-piece solid golf ball according to the present invention should meet the requirement that difference between the JIS-C hardness of core surface and the JIS-C hardness of core center should be no smaller than 20, preferably no smaller than 23, more preferably no smaller than 25, and no larger than 40, preferably no larger than 30. With an excessively small value, the resulting golf ball may be poor in flight performance due to insufficient spin reducing effect. With an excessively large value, the resulting golf ball may be poor in crack durability when repeated hitting.

Regarding Requirement (13):

The multi-piece solid golf ball according to the present invention should meet the requirement that the difference between the JIS-C hardness of surface of intermediate layer and the JIS-C hardness of surface of core should be no smaller than −5, preferably no smaller than −4, more preferably no smaller than −3, and no larger than +5, preferably no larger than +4, more preferably no larger than +3. With a value outside the specified limits, the resulting golf ball may not have balanced flying performance and feel.

The multi-piece solid golf ball according to the present invention should conform to the golf rules for competition. It should have a diameter no smaller than 42.67 mm and no larger than 44.0 mm, preferably no larger than 43.5 mm, more preferably no larger than 44.5 mm. It should have a weight no larger than 45.93 g and no smaller than 44.5 g, preferably no smaller than 44.8 g, more preferably no smaller than 45.0 g, and particularly no smaller than 45.1 g.

EXAMPLE

The invention will be described in more detail with reference to the following Examples and Comparative Examples which are not intended to restrict the scope thereof.

Examples 1 to 3 and Comparative Examples 1 to 5

A sample of the center core was prepared from the rubber compound shown in Table 1 (in terms of parts by weight) by vulcanization at 155° C. for 15 minutes and ensuing surface polishing. An unvulcanized sheet was prepared from the rubber compound shown in Table 2 (in terms of parts by weight). This sheet was formed into a semispherical shape by compression in a mold having a semispherical projection. The molded sheet of unvulcanized sheet was placed on the center core and then vulcanized by heating at 155° C. for 15 minutes. After surface polishing, there was obtained a sample of the core (consisting of a center core and an outer layer).

The core was covered with an intermediate layer and a cover by injection molding with the compounds shown in Table 3. Thus there was obtained the desired golf ball.

Table 4 shows the results of evaluation of the thus obtained golf balls.

TABLE 1

| Parts by weight | | Example 1 | Example 2 | Example 3 | Comparative Example 1 | Comparative Example 2 | Comparative Example 3 | Comparative Example 4 | Comparative Example 5 |
|---|---|---|---|---|---|---|---|---|---|
| Compound for center core | Polybutadiene A | 100 | 100 | 100 | 100 | 100 | 100 | 100 | 100 |
| | Zinc acrylate | 14 | 11 | 11 | 11 | 23.7 | 11 | 14 | 11 |
| | Peroxide (1) | 0.6 | 0.6 | 0.6 | 0.6 | 0.6 | 0.6 | 0.6 | 0.6 |
| | Peroxide (2) | 0.6 | 0.6 | 0.6 | 0.6 | 0.6 | 0.6 | 0.6 | 0.6 |
| | Antioxidant | 0.1 | 0.1 | 0.1 | 0.1 | 0.1 | 0.1 | 0.1 | 0.1 |
| | Zinc oxide | 27.3 | 28.5 | 28.5 | 28.5 | 24.1 | 28.5 | 27.3 | 28.5 |

* Comparative Example 2 is concerned with a core consisting of a center core alone (without the core outer layer).

TABLE 2

| Parts by weight | | Example 1 | Example 2 | Example 3 | Comparative Example 1 | Comparative Example 3 | Comparative Example 4 | Comparative Example 5 |
|---|---|---|---|---|---|---|---|---|
| Compound for core outer layer | Polybutadiene B | 100 | 100 | 100 | 100 | 100 | 90 | 100 |
| | Polyisoprene rubber | 0 | 0 | 0 | 0 | 0 | 10 | 0 |
| | Zinc acrylate | 30.5 | 26 | 30.5 | 30.5 | 30.5 | 30.5 | 30.5 |
| | Peroxide (1) | 0.3 | 0.3 | 0.3 | 0.3 | 0.3 | 0.6 | 0.3 |
| | Peroxide (2) | 0.3 | 0.3 | 0.3 | 0.3 | 0.3 | 0.6 | 0.3 |
| | Antioxidant | 0.1 | 0.1 | 0.1 | 0.1 | 0.1 | 0.1 | 0.1 |
| | Zinc oxide | 22.4 | 24.3 | 22.4 | 22.4 | 22.4 | 22.4 | 18.1 |
| | Zinc salt of pentachlorothiophenol | 0.3 | 0.1 | 0.3 | 0.3 | 0.3 | 0 | 0.3 |
| | Zinc stearate | 5 | 5 | 5 | 5 | 5 | 0 | 5 |

Polybutadiene A: "BR01" from JSR Corporation
Polybutadiene B: "BR730" from JSR Corporation
Polyisoprene rubber: "IR2200" from JSR Corporation
Peroxide (1): Dicumyl peroxide "Percumyl D" from NOF Corporation
Peroxide (2): 1,1-bis(t-butylperoxy)3,3,5-trimethylcyclohexane "Perhexa 3M-40" from NOF Corporation
Antioxidant: "Nocrac NS-6" from Ouchishinko Chemical Industrial Co., Ltd.
Zinc stearate: "Zinc stearate G" from NOF Corporation

TABLE 3

| Parts by weight | Composition A | B | C | D | E | F |
|---|---|---|---|---|---|---|
| Surlyn 8120 | 75 | | | | | 35 |
| Surlyn 7930 | | | | 22.5 | | |
| AM7311 | | | | 21 | | |
| AM7317 | | 50 | | | | |
| AM7318 | | 50 | | | | |
| Himilan 1706 | | | | | 25 | |
| Himilan 1605 | | | | | 50 | |
| Himilan 1855 | | | | | | 35 |
| Surlyn 9945 | | | | | 25 | |
| AN4318 | | | | 26.5 | | 30 |
| Hytrel 3046 | | | 100 | | | |
| Dynaron E6100P | 25 | | | 30 | | |
| Behenic acid | 20 | | | | | |
| Calcium hydroxide | 2.3 | | | | | |

TABLE 3-continued

| Parts by weight | Composition A | B | C | D | E | F |
|---|---|---|---|---|---|---|
| Titanium oxide | | 5 | | | 4 | 5 |
| MFR (g/10 min) | 2.1 | 1.7 | 10 | 2.5 | 3 | 5 |

Surlyn 8120, 7930, 9945: Ionomers from Du Pont
AM7311, 7317, 7318: Ionomers from Du Pont-Mitsui Polychemicals Co., Ltd.
7311 - magnesium-based ionomer
7317 - zinc-based ionomer containing 18% acid
7318 - sodium-based ionomer containing 18% acid
Himilan 1706, 1605, 1855: Ionomers from Du Pont-Mitsui Polychemicals Co., Ltd.
AN4318: "Nucrel" from Du Pont-Mitsui Polychemicals Co., Ltd.
Hytrel 3046: Polyester elastomer from Du Pont-Toray Co., Ltd.
Dynaron 6100P: Hydrogenated polymer from JSR Corporation
Behenic acid: "NAA222-S" (beads) from NOF Corporation
Calcium hydroxide: "CLS-B" from Shiraishi Kogyo Kaisha, Ltd.
MFR (g/10 min): Melt flow rate measured at 190° C. under a load of 21 N (2.16 kgf) according to JIS-K6760.

TABLE 4

| | | Example | | | Comparative Example | | | | |
|---|---|---|---|---|---|---|---|---|---|
| | | 1 | 2 | 3 | 1 | 2 | 3 | 4 | 5 |
| Center | Outer diameter (mm) | 25.0 | 18.1 | 18.1 | 18.1 | | 18.1 | 25.0 | 18.1 |
| Core | Center hardness (JIS-C) | 51 | 50 | 50 | 50 | | 50 | 51 | 50 |
| Core | Outer diameter (mm) | 37.7 | 37.7 | 37.7 | 37.7 | 37.7 | 37.7 | 37.7 | 37.7 |
| (center core | Deflection amount (mm) | 4.0 | 3.8 | 3.6 | 3.6 | 3.6 | 3.6 | 4.0 | 3.6 |
| plus | Initial velocity (m/s) | 77.1 | 77.0 | 77.3 | 77.3 | 77.0 | 77.3 | 76.7 | 77.3 |
| outer layer) | Surface hardness (JIS-C) | 78 | 75 | 79 | 79 | 76 | 79 | 78 | 79 |
| | Difference between surface hardness and center hardness (JIS-C) | 27 | 25 | 29 | 29 | 17 | 29 | 27 | 29 |
| Intermediate | Material | A | A | A | A | A | D | B | C |
| layer | Specific gravity | 0.94 | 0.94 | 0.94 | 0.94 | 0.94 | 0.93 | 0.98 | 1.07 |
| | Shore D hardness of sheet | 51 | 51 | 51 | 51 | 51 | 51 | 65 | 30 |
| | JIS-C hardness of sheet | 78 | 78 | 78 | 78 | 78 | 78 | 96 | 50 |
| | Thickness (mm) | 1.25 | 1.25 | 1.25 | 1.25 | 1.25 | 1.25 | 1.25 | 1.25 |
| Sphere | Outer diameter (mm) | 40.2 | 40.2 | 40.2 | 40.2 | 40.2 | 40.2 | 40.2 | 40.2 |
| (enclosed with | Deflection amount (mm) | 3.8 | 3.7 | 3.4 | 3.4 | 3.4 | 3.4 | 3.4 | 3.7 |
| intermediate layer) | Initial velocity (m/s) | 77.4 | 77.3 | 77.6 | 77.6 | 77.3 | 77.0 | 77.4 | 76.9 |
| Cover | Material | E | E | E | F | E | E | E | E |
| | Specific gravity | 0.97 | 0.97 | 0.97 | 0.96 | 0.97 | 0.97 | 0.97 | 0.97 |
| | Shore D hardness of sheet | 63 | 63 | 63 | 48 | 63 | 63 | 63 | 63 |
| | Thickness (mm) | 1.25 | 1.25 | 1.25 | 1.25 | 1.25 | 1.25 | 1.25 | 1.25 |
| Ball | Outer diameter (mm) | 42.7 | 42.7 | 42.7 | 42.7 | 42.7 | 42.7 | 42.7 | 42.7 |
| | Weight (g) | 45.1 | 45.1 | 45.1 | 45.0 | 45.1 | 45.0 | 45.3 | 45.4 |
| | Deflection amount (mm) | 3.2 | 3.1 | 2.9 | 3.3 | 2.9 | 2.9 | 2.9 | 3.3 |
| | Initial velocity (m/s) | 77.5 | 77.1 | 77.4 | 76.6 | 77.1 | 76.9 | 77.2 | 76.8 |
| | Intermediate layer hardness − Core surface hardness (JIS-C) | 0 | 3 | −1 | −1 | 2 | −1 | 18 | −29 |
| | Core hardness − Intermediate layer hardnes (JIS-C) | 12 | 12 | 12 | −3 | 12 | 12 | −2 | 33 |
| | Sphere (enclosed with intermediate layer) initial velocity − Core initial velocity (m/s) | 0.3 | 0.3 | 0.3 | 0.3 | 0.3 | −0.3 | 0.7 | −0.4 |
| | Sphere (enclosed with intermediate layer) deflection amount/ Core deflection amount | 0.95 | 0.96 | 0.94 | 0.94 | 0.94 | 0.94 | 0.85 | 1.02 |
| | Total thickness (mm) (Cover thickness + Intermediate layer thickness) | 2.5 | 2.5 | 2.5 | 2.5 | 2.5 | 2.5 | 2.5 | 2.5 |
| | Ball deflection amount/ Sphere deflection amount | 0.84 | 0.84 | 0.85 | 0.97 | 0.85 | 0.85 | 0.85 | 0.89 |
| Flight | Total (m) | 161.9 | 162.3 | 162.0 | 156.7 | 158.8 | 159.8 | 159.4 | 158.7 |
| Performance, | Spin (rpm) | 3231 | 3234 | 3238 | 3643 | 3352 | 3258 | 3301 | 3338 |
| W#1, HS 35 m/s | Evaluation of flight distance | ○ | ○ | ○ | X | X | X | X | X |
| | Feel (W#1) | ○ | ○ | ○ | ○ | ○ | ○ | ○ | ○ |
| | Feel (Putter) | ○ | ○ | ○ | ○ | ○ | ○ | X | ○ |
| | Crack durability | ○ | ○ | ○ | ○ | ○ | ○ | X | X |
| | Scuff resistance | ○ | ○ | ○ | X | ○ | ○ | ○ | ○ |

* Comparative Example 2 is concerned with a ball in which the core consists of a center core alone. Hardness at the center of the center core is 60 (JIS-C).

Flight Performance

Flight performance was measured by hitting a sample ball at a head speed of 35 m/s with a W#1 club attached to a golf hitting robot. The W#1 club is "TourStage V36" (from Bridgestone Sports), with a loft of 12.5°. Sample balls were rated according to the following criterion.

○: no less than 160.0 m of total distance

X: less than 160.0 m of total distance

Feel of Hitting with W#1 and Putter

Feel was evaluated by sensory test of ten amature golfers who achieve the head speed of 35-40 m/s with W#1 club. Sample balls were rated according to the following criterion.

○: Seven or more golfers out of ten had a good feel

X: Four or less golfers out of ten had a good feel

Crack Durability

Crack durability was rated in terms of the number of repeated hitting which is required for the ball surface to crack. Sample balls were hit at a head speed of 40 m/s by a W#1 club attached to a golf hitting robot. This test was repeated three times for each sample ball, and an average of measurements was obtained. The results are indicated in terms of index, with the result in Example 1 being 100. Sample balls were rated according to the following criterion.

○: Index no lower than 95

X: Index lower than 95

Scuff Resistance

Scuff resistance was evaluated by hitting a sample ball once at a head speed of 40 m/s with a non-plated pitching sand wedge attached to a hitting robot. After hitting, the ball surface is visually observed. Sample balls were rated according to the following criterion.

○: Still usable.

X: Not usable any longer.

Sample balls in Comparative Example 1 are poor in flying distance because of the excessively soft cover which results in low rebound resilience and excessive spin.

Sample balls in Comparative Example 2 are poor in flying distance because of their single-piece core which does not reduce spin.

Sample balls in Comparative Example 3 are poor in flying distance because of their low rebound resilience, which results from the fact that the difference between the initial velocity (m/s) of the core enclosed with the intermediate layer and the initial velocity (m/s) of the core alone is smaller than −0.2.

Sample balls in Comparative Example 4 are poor in flying distance because of their excessively hard intermediate layer which results in excessive spin at the time of hitting with a W#1 club. They also give a hard feel when hit with a putter, and they are poor in crack durability when repeated hitting.

Sample balls in Comparative Example 5 are poor in flying distance because of their excessively soft intermediate layer which results in excessive spin at the time of hitting with a W#1 club. They are also poor in crack durability when repeated hitting because of incomplete adhesion between the core and the intermediate layer.

The invention claimed is:

1. A golf ball comprising a core having a plurality of layers, an intermediate layer enclosing the core to form a sphere, and a cover enclosing the intermediate layer, wherein each component has a Shore D hardness, a Deflection amount, an initial velocity (in m/s) and a thickness (in mm), the Deflection amount being defined as an amount of deflection (in mm) under load of a spherical body incurred when the load is increased from an initial value of 98 N (10 kgf) to a final value of 1275 N (130 kgf), and the ball satisfies the following requirements (1) to (3):

(1) (Shore D hardness of the cover)−(Shore D hardness of the intermediate layer)>0, (2) (initial velocity of the sphere)−(initial velocity of the core)>−0.2, and (3) 0.90≦(Deflection amount of the sphere)/(Deflection amount of the core)≦1.00.

2. The golf ball of claim 1 which further satisfies the following requirements (4) to (9):

(4) the total of the thickness of the intermediate layer and the thickness of the cover is up to 3.0 mm, (5) the thickness of the cover is from 0.5 mm to 2.0 mm, (6) the Shore D hardness of the cover is from 55 to 70, (7) the thickness of the intermediate layer is from 0.5 mm to 1.6 mm, (8) the Shore D hardness of the intermediate layer is from 40 to 60, and (9) the golf ball has an initial velocity of at least 76.5 m/s.

3. The golf ball of claim 1 which further satisfies the following requirement (10):

(10) the cover has a melt flow rate of at least 2 g/10 min.

4. The golf ball of claim 1 which further satisfies the following requirement (11):

(11) 0.85≦(Deflection amount of the golf ball)/(Deflection amount of the sphere)≦0.95.

5. The golf ball of claim 1 wherein said intermediate layer comprises (A) an ionomer resin comprising (a-1) an olefin/unsaturated carboxylic acid binary random copolymer and/or a metal ion neutralized product thereof and (a-2) an olefin/unsaturated carboxylic acid/unsaturated carboxylic acid ester ternary random copolymer and/or a metal ion neutralized product thereof in a weight ratio (a-1)/(a-2) between 100/0 and 0/100, and (B) a non-ionomeric thermoplastic elastomer in a weight ratio A/B between 100/0 and 50/50.

6. The golf ball of claim 5 wherein said intermediate layer is made of a mixture comprising 100 parts by weight of a resin component comprising the ionomer resin (A) and the non-ionomeric thermoplastic elastomer (B) in a weight ratio A/B between 100/0 and 50/50, (C) 5 to 80 parts by weight of an organic fatty acid and/or a derivative thereof having a molecular weight of 280 to 1,500, and (D) 0.1 to 10 parts by weight of a basic inorganic metal compound capable of neutralizing un-neutralized acid groups in said resin component and component (C).

7. The golf ball of claim 1 which meets the following requirement (12).

(12) (JIS-C hardness of core surface)−(JIS-C hardness of core center)≧20.

8. The golf ball of claim 1 which meets the following requirement (13).

(13) 5≧(JIS-C hardness of surface of intermediate layer)−(JIS-C hardness of core surface)≧−5.

* * * * *